US009072648B2

(12) United States Patent
Lev et al.

(10) Patent No.: US 9,072,648 B2
(45) Date of Patent: Jul. 7, 2015

(54) BODY MASSAGE APPARATUS

(75) Inventors: Mordechai Lev, West Bloomfield, MI (US); Hing Wah Tsang, Ajax (CA)

(73) Assignee: FKA Distributing Co., LLC, Commerce Township, MI (US)

( * ) Notice: Subject to any disclaimer, the term of this patent is extended or adjusted under 35 U.S.C. 154(b) by 571 days.

(21) Appl. No.: 13/408,509

(22) Filed: Feb. 29, 2012

(65) Prior Publication Data

US 2012/0226207 A1 Sep. 6, 2012

(51) Int. Cl.
*A61H 9/00* (2006.01)
*A61H 7/00* (2006.01)

(52) U.S. Cl.
CPC ..... *A61H 7/004* (2013.01); *A61H 9/0078* (2013.01); *A61H 2201/0149* (2013.01); *A61H 2201/0207* (2013.01); *A61H 2201/1215* (2013.01); *A61H 2201/123* (2013.01); *A61H 2201/1623* (2013.01); *A61H 2201/1664* (2013.01); *A61H 2201/1669* (2013.01); *A61H 2201/1671* (2013.01); *A61H 2201/5002* (2013.01); *A61H 2201/5007* (2013.01); *A61H 2201/5035* (2013.01); *A61H 2201/5038* (2013.01); *A61H 2201/5097* (2013.01); *A61H 2205/081* (2013.01); *A61H 2205/106* (2013.01)

(58) Field of Classification Search
CPC ..... A61H 7/00; A61H 7/001; A61H 7/002; A61H 7/004; A61H 7/007; A61H 9/00; A61H 9/0028; A61H 9/005; A61H 9/0078; A61H 9/0092; A61H 15/00; A61H 15/0078; A61H 2201/0103; A61H 2201/0134; A61H 2201/0138; A61H 2201/0149; A61H 2201/12; A61H 2201/1238; A61H 2201/1623; A61H 2201/1628; A61H 2201/1633; A61H 2205/081
USPC ..... 417/412, 413.1, 566, 423.4, 420; 601/148–152
See application file for complete search history.

(56) References Cited

U.S. PATENT DOCUMENTS

| | | | | |
|---|---|---|---|---|
| 3,606,597 | A * | 9/1971 | Russell | 417/542 |
| 4,721,438 | A * | 1/1988 | Ichinomiya et al. | 417/316 |
| 4,981,131 | A * | 1/1991 | Hazard | 601/24 |
| 5,332,370 | A * | 7/1994 | Nakayama et al. | 417/413.1 |
| 6,506,033 | B2 * | 1/2003 | Fukami | 417/420 |
| 6,517,500 | B2 | 2/2003 | Ichikawa | |
| 6,916,300 | B2 | 7/2005 | Hester et al. | |
| 7,285,102 | B1 * | 10/2007 | Chang | 601/98 |
| 2004/0097854 | A1 * | 5/2004 | Hester et al. | 601/149 |
| 2005/0004497 | A1 * | 1/2005 | Dehli | 601/148 |
| 2006/0073045 | A1 * | 4/2006 | Tsai | 417/423.14 |
| 2006/0120897 | A1 * | 6/2006 | Yu et al. | 417/413.1 |
| 2006/0217643 | A1 | 9/2006 | Yonekawa et al. | |
| 2008/0077068 | A1 * | 3/2008 | Orr | 604/6.11 |
| 2008/0183113 | A1 | 7/2008 | Kazerounian et al. | |
| 2009/0047150 | A1 * | 2/2009 | Chang | 417/375 |
| 2010/0063430 | A1 * | 3/2010 | Dehli | 601/149 |
| 2010/0137758 | A1 * | 6/2010 | Nagamitsu et al. | 601/97 |
| 2010/0145245 | A1 * | 6/2010 | Chen | 601/149 |
| 2012/0224984 | A1 * | 9/2012 | Orr | 417/395 |
| 2012/0315166 | A1 * | 12/2012 | Looi et al. | 417/413.1 |

* cited by examiner

*Primary Examiner* — Quang D Thanh
(74) *Attorney, Agent, or Firm* — Brooks Kushman P.C.

(57) ABSTRACT

A body massage apparatus is provided with a housing. A massage unit is provided in the housing. A pair of laterally spaced apart air bladders is provided on the housing with the massage unit oriented between the air bladders.

14 Claims, 6 Drawing Sheets

BODY MASSAGE APPARATUS

TECHNICAL FIELD

Various embodiments relate to body massage apparatuses.

BACKGROUND

The prior art has provided various massagers, including massagers with a housing, a carriage in the housing for translation in the housing, and a massage assembly on the carriage. Examples of carriage massagers include U.S. Pat. No. 7,128,721 B2 issued to Ferber et al. on Oct. 31, 2006, and U.S. Pat. No. 7,470,242 B2 issued to Ferber et al. on Dec. 30, 2008.

SUMMARY

According to at least one embodiment, a body massage apparatus is provided with a housing. A massage unit is provided in the housing. A pair of laterally spaced apart air bladders is provided on the housing with the massage unit oriented between the air bladders.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
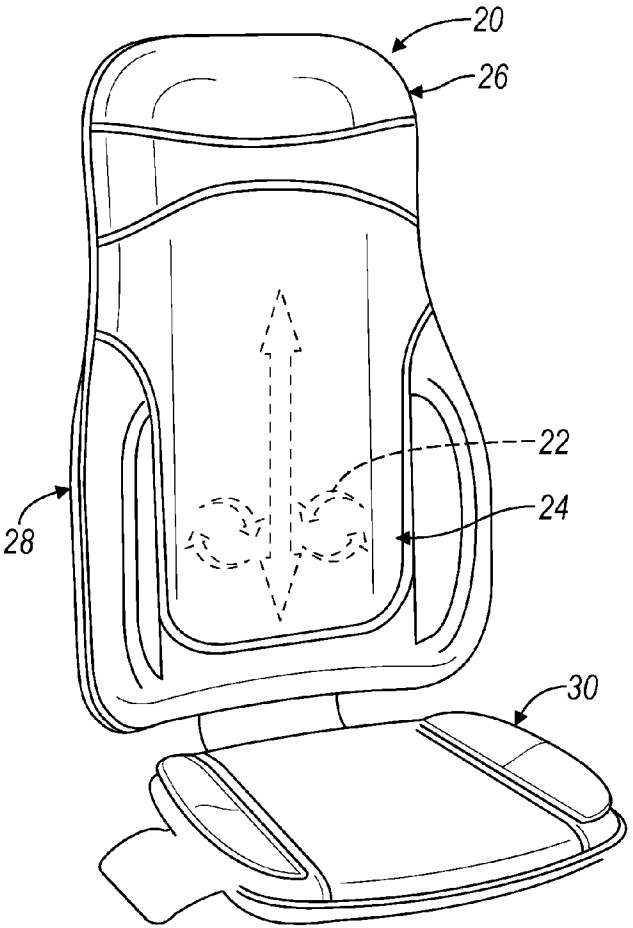
FIG. 1 is a front perspective view of a body massage apparatus according to at least one embodiment.

A body massage apparatus 20 with adjustable intensity is illustrated in FIG. 1. According to at least one embodiment, the massage apparatus 20 is a massage cushion 20 having a Shiatsu massage effect. Shiatsu massage heads 22 are provided on a traveling carriage 24 for upright travel along a backrest 26 of the massage cushion 20. Included with the carriage 24 is at least one inflatable air bladder. The air bladder imparts a massage, in conjunction with the Shiatsu massage heads 22, to a lumbar region 28. The air bladder can form around an outer perimeter of each massage head 22 and is connected to the carriage 24 for travel with the massage heads 22. Prior art bladders are generally fixed to the cushion structure and cannot travel with the massage head carriage. While similarly inflatable, the bladders do not amend the massage intensity and are not located in the proximity of the massager heads.

A seat 30 of the cushion 20 may also include air bladders for imparting a massage to a thigh region of the user. Both the lumbar 28 and seat 30 air bladders may be expanded with compressed air in a range of no to full air. When fully inflated, the air bladder extends beyond the outer edges of the massage heads 22 of the lumbar region 28 and when fully deflated the air bladder deflates into an area of the carriage 24 below the massage heads 22. An integrated or wireless programmable controller is provided for controlling movement of the massage heads 22 and inflation of the air bladder by the user. By inflating the bladder, the intensity of the massager 20 is adjusted to a lower level by moving the user away from the massage head 22. As the bladder is inflated, cushioning is created between the massage heads 22 and the user's body. The intensity level of the massager 20 is greatest when the bladder is not inflated and the intensity level is least when the bladder is fully expanded. Previous massage cushions have lowered the intensity level of the massage head by retracting the massage head itself into the cushion area. The use of an expandable bladder can eliminate the need to amend a standard massage cushion carriage while successfully providing a full range of massage intensity.

The adjustable bladder cushion 20 may be used with any massage unit and location. For instance, an adjustable air bladder may be included with a folding foot and calf massager described above. Additionally, an adjustable air bladder may be included within a seat massager, a back massager, the lumbar area, and the neck area by way of example. Further, the air bladder intensity may be adjusted manually with a hand or foot pump or electronically via an included controller.

An embodiment of the massage cushion 20 includes a folding region between the back lumbar region 28 and the seat 30. The cushion 20 is foldable and more portable than the other cushions known in the art. The portable cushion 20 is a ready travel companion. The massage cushion 20 can be equipped with heat.

Additional features may include:

Thigh and lumbar air massage with adjustable intensity control.

Travelling Shiatsu massage.

Soothing heat.

3 customizable Shiatsu massage programs.

6 customizable air massage programs.

Convenient corded control.

Additional benefits may include:

Air and Shiatsu massage combined together for an ultimate massage.

Air compression massage is finally brought into an affordable and portable cushion 20.

Figure 2:
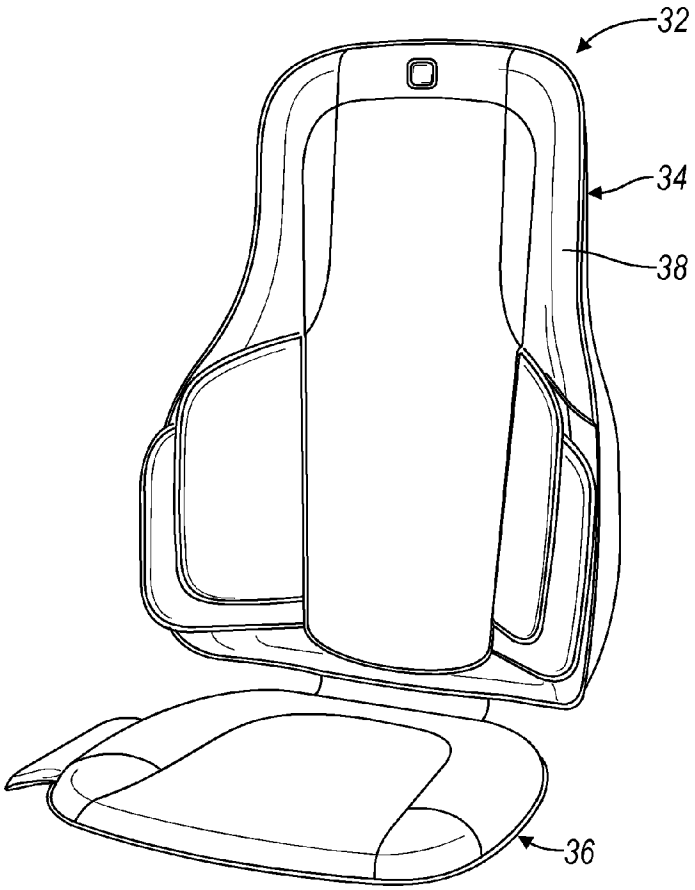
FIG. 2 is a front perspective view of a body massage apparatus according to at least another embodiment.
Figure 4:
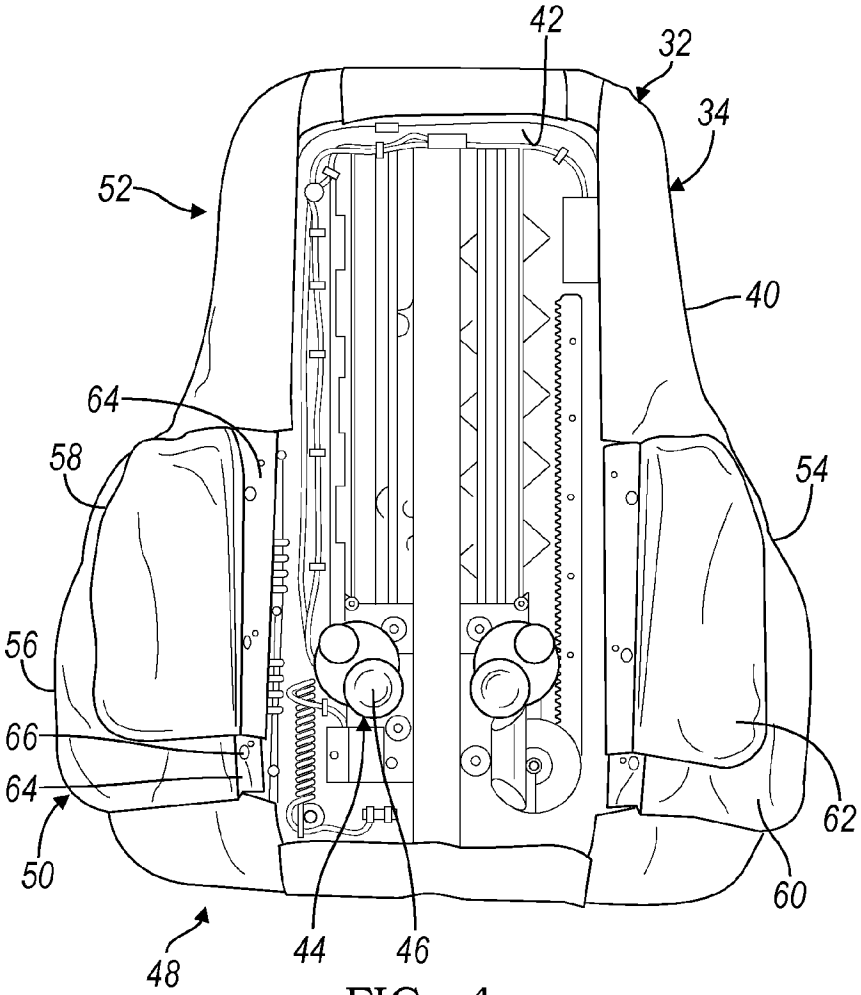
FIG. 4 is a front perspective view of the body massage apparatus of FIG. 2 illustrated with the cover removed.
Figure 3:
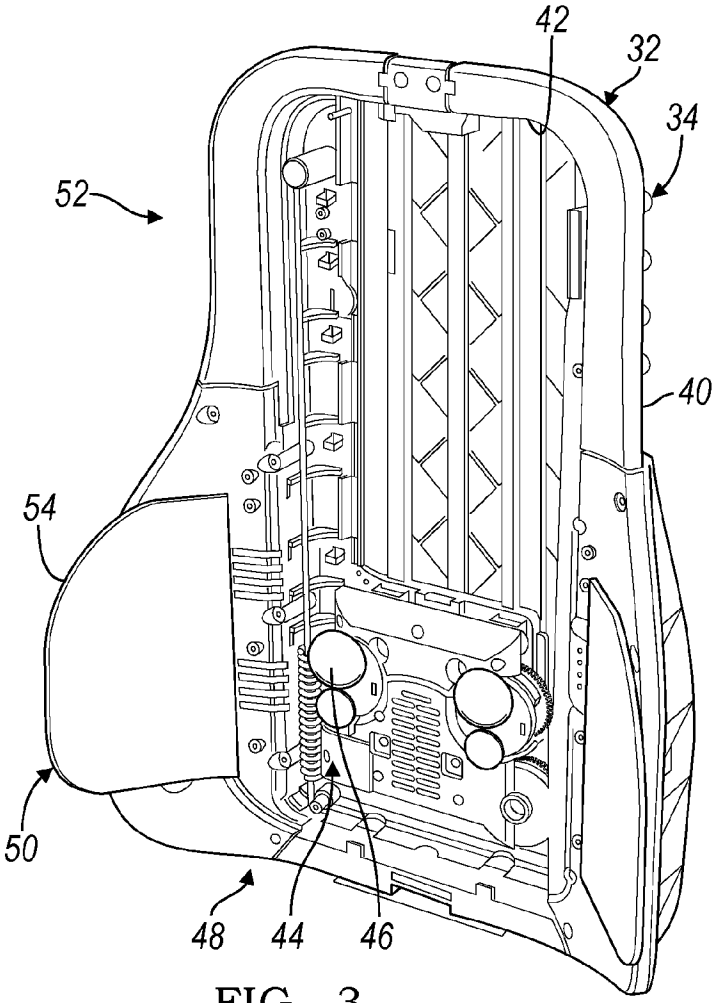
FIG. 3 is a front perspective view of the body massage apparatus of FIG. 2 illustrated with a cover and air bladders removed.

Referring now to FIGS. 2-4, a body massage apparatus 32 is illustrated according to another embodiment. The body massage apparatus 32 includes a backrest 34 and a seat 36. The backrest 34 and the seat 36 are each sized to be received and supported upon a conventional chair. Of course the massage apparatus 32 may be employed upon an underlying support surface without a supporting chair.

FIGS. 3 and 4 illustrate the massage apparatus 32 with a cover 38 (FIG. 2) removed for revealing underlying components. The backrest 34 includes a housing 40 with a cavity 42 for receiving a carriage 44 with a massage formation 46. The carriage 44 may include one or more motors for driving the carriage 44 along the housing 40, and for driving the massage formation 46 to provide a rotary kneading massage effect. Both functions of the carriage 44 are known in the art.

Figure 6:
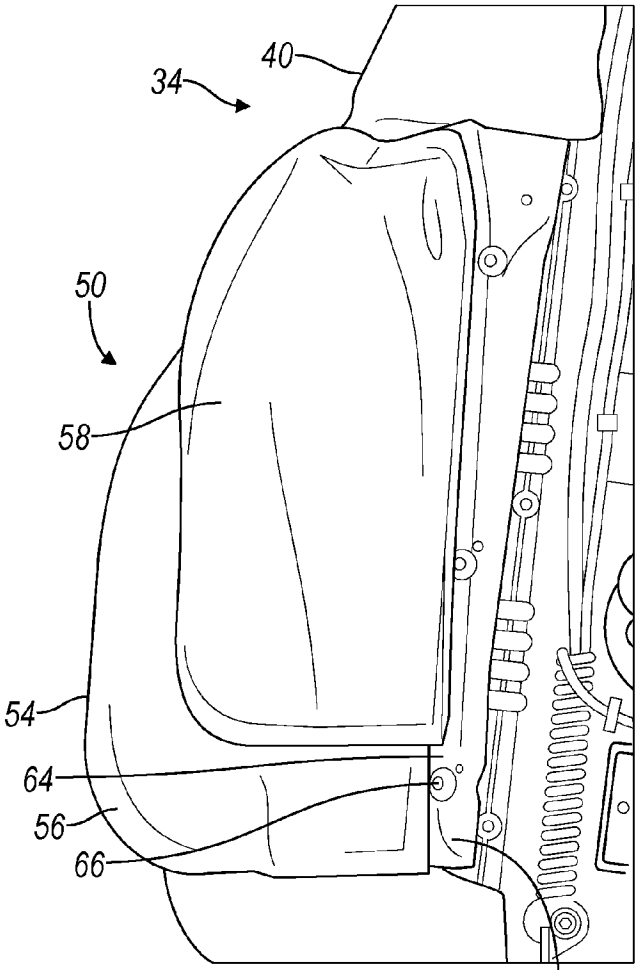
FIG. 6 is an enlarged front perspective view of the body massage apparatus of FIG. 2 illustrating one pair of air bladders.
Figure 5:
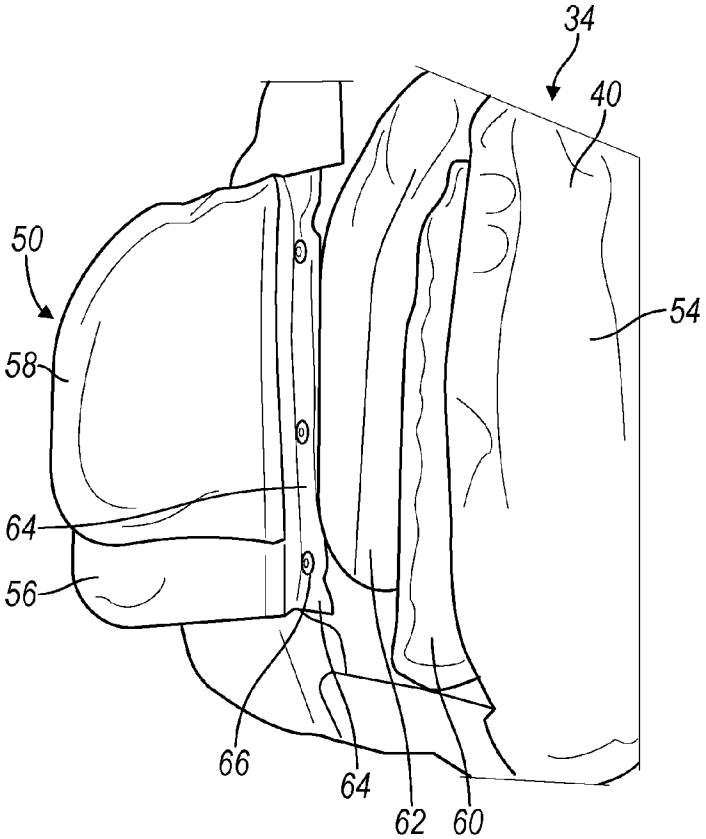
FIG. 5 is an enlarged side perspective view of the body massage apparatus of FIG. 2 illustrating two pairs of air bladders.

The housing 40 has a pelvic region 48, a lumbar region 50 and a thoracic region 52. The lumbar region 50 includes a pair of lateral supports or bolsters 54 extending laterally outward from the cavity 42 for providing additional lateral support. Referring specifically to FIGS. 4-6, two pairs of air bladders 56, 58, 60, 62 are provided on the bolsters 54. One pair of air bladders 56, 58, 60, 62 are provided on each bolster 54. Although two pairs of air bladders 56, 58, 60, 62 are illustrated and described, any number of air bladders is contemplated within the spirit and the scope of the present invention. The pairs of air bladders 56, 58, 60, 62 may be inflated together or separately for lower inflation, upper inflation and/or combined upper and lower inflation.

Each air bladder 56, 58, 60, 62 is formed from a polymeric material that is flexible and air resistant to retain compressed air therein. As illustrated in FIGS. 4-6, each air bladder 56, 58, 60, 62 includes a mounting flap 64 for fastening each air bladder 56, 58, 60, 62 to the housing 40 by a series of fasteners 66. Each pair of air bladders 56, 58, 60, 62 is not aligned. In other words, each pair includes an upper air bladder 58, 62 overlapping a lower air bladder 56, 60. The overlap permits an increased compression effect while permitting a minimal compressive effect, where the air bladders 56, 58, 60, 62 are not overlapping.

Figure 7:
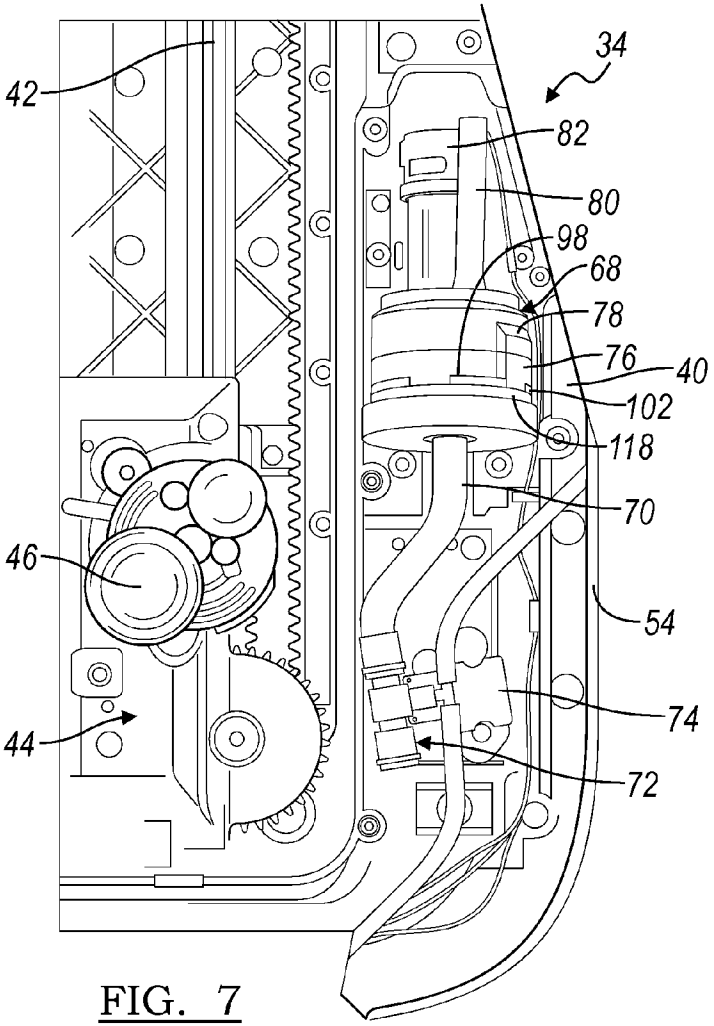
FIG. 7 is an enlarged front perspective view of the body massage apparatus of FIG. 2 illustrating an air compressor assembly.

Referring now to FIG. 7, the body massage apparatus 32 includes an air compressor assembly 68 retained within one of the housing bolsters 54 for compressing air and inflating the air bladders 56, 58, 60, 62. The air compressor assembly 68 has an outlet duct 70 connected to a valve assembly 72 which regulates the inflation of the air bladders 56, 58, 60, 62. A solenoid 74 is connected to the valve assembly 72 for actuating the valve assembly 72. The solenoid 74 is controlled by a massage controller (not shown) for controlling the inflation and deflation of the air bladders 56, 58, 60, 62. The valve assembly 72 may have two positions, for inflation and deflation. During inflation, compressed air passes from the air compressor assembly 68, through the valve assembly 72, to the air bladders 56, 58, 60, 62. During deflation, the air bladders 56, 58, 60, 62 retract, thereby exhausting the compressed air from the air bladders 56, 58, 60, 62 and through the valve assembly 72. Alternatively, the valve assembly 72 may have four positions, upper inflation, upper deflation, lower inflation, and lower deflation for independent inflation and deflation of the upper air bladders 58, 62 and the lower air bladders 56, 60.

Figure 8:
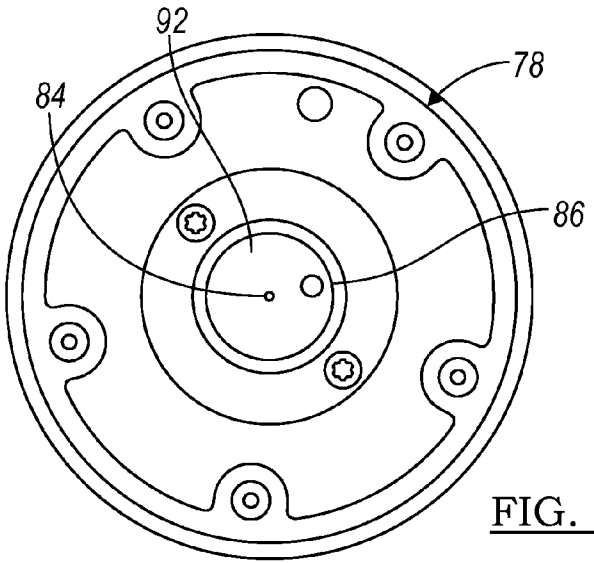
FIG. 8 is an enlarged axial perspective view of the air compressor assembly of FIG. 7 illustrated partially disassembled depicting an eccentric drive and a first end cap.

The air compressor assembly 68 includes a compressor housing 76 illustrated in FIG. 7 mounted to the backrest housing 40. The compressor housing 76 includes a first end cap 78, which is illustrated in FIGS. 7 and 8. An air inlet duct 80 is mounted to the first end cap 78 as illustrated in FIG. 7, for intake of air into the compressor housing 76. A motor 82 is mounted to the first end cap 78 for driving the air compressor assembly 68. The motor 82 drives a rotary output shaft 84 that extends through the first end cap 78 into the compressor housing 76.

Figure 9:
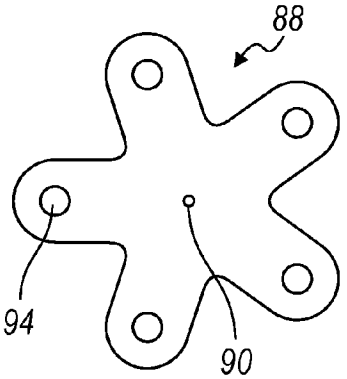
FIG. 9 is an enlarged axial perspective view of a drive plate of the air compressor assembly of FIG. 7.

In FIG. 8, an eccentric drive 86 is mounted to the rotary output shaft 84. A drive plate 88 (illustrated in FIG. 9) has a central shaft 90 that is received in an offset aperture 92 (FIG. 8). The drive plate 88 (FIG. 9, again) has a radial array of apertures 94 formed around the central shaft 90.

Figure 11:
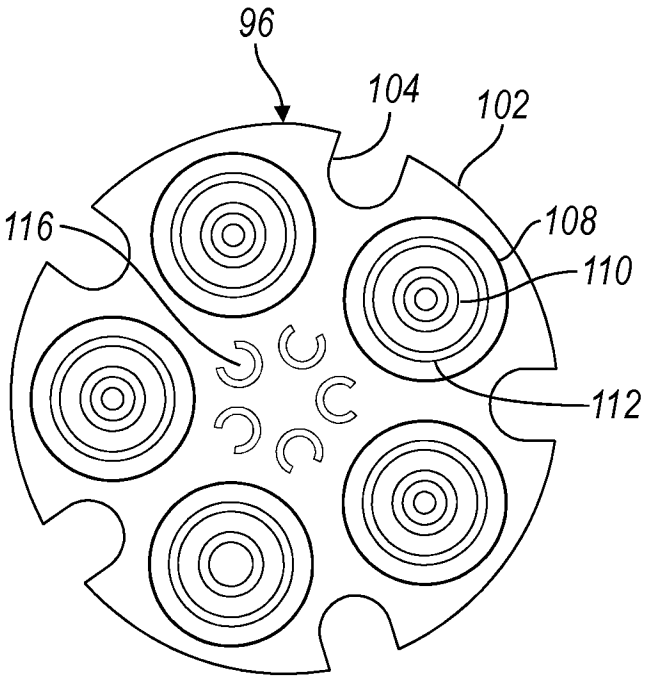
FIG. 11 is an enlarged axial perspective view of the diaphragm valve of FIG. 10.
Figure 10:
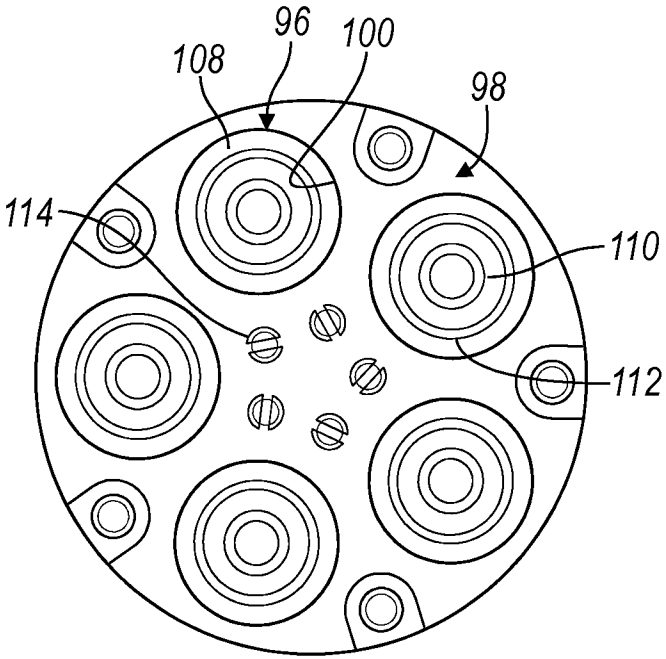
FIG. 10 is an enlarged axial perspective view of the air compressor assembly of FIG. 7, illustrating an intermediate retainer plate and a diaphragm valve.
Figure 13:
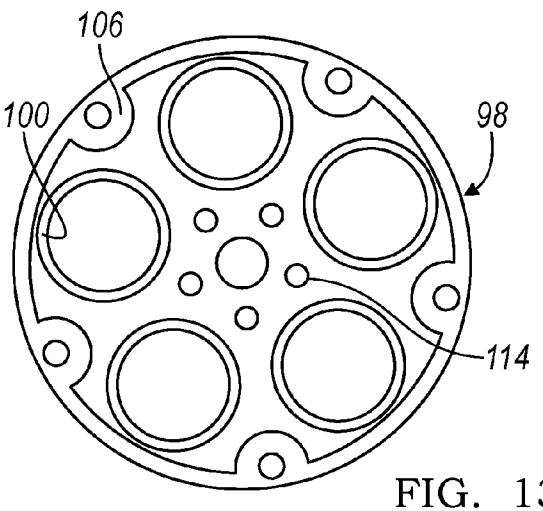
FIG. 13 is an enlarged axial perspective view of the intermediate retainer plate of FIG. 10.
Figure 12:
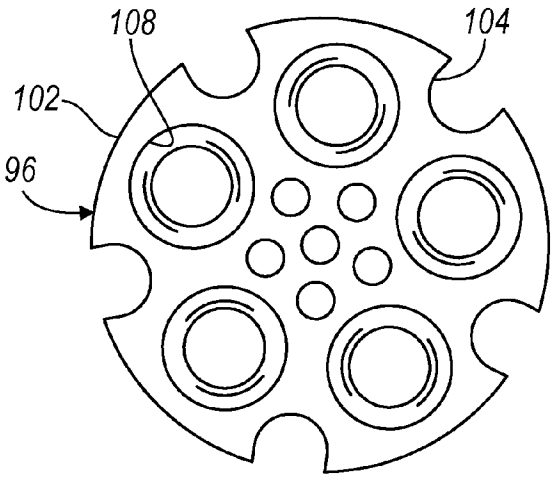
FIG. 12 is another enlarged axial perspective view of the diaphragm valve of FIG. 10.

Referring to FIGS. 10-12, a diaphragm valve 96 is illustrated for compressing the air. The diaphragm valve is separated from the first end cap 78 by an intermediate retainer plate 98 that is fastened to the first end cap 78. The retainer plate 98 is illustrated in FIGS. 10 and 13; and has a series of receptacles 100 formed through the plate 98. The diaphragm valve 96 has a substrate 102 that is seated against the retainer plate 98. The substrate 102 has a series of recesses 104 for receiving lugs 106 on the retainer plate 98. A series of diaphragms 108 are extend from the substrate 102, each into one of the receptacles 100. An elastomeric connector 110 extends from a dome of each diaphragm 108 through the receptacles 108, and through one of the apertures 94 on the drive plate 88. Each connector 110 has an enlarged head 112 for retention of the connector 110 in the drive plate aperture 94.

The connection of the drive plate 88 to the diaphragm valve 96 prevents the drive plate 88 from full rotation. Therefore, the drive plate 88 oscillates around the motor shaft 84 due to the offset of the drive plate shaft 90. The oscillation of the drive plate 88 causes each of the diaphragms 108 to expand and retract. A series of air inlets 114 are provided through the retainer plate 98. A corresponding series of flapper valves 116 are provided on the substrate 102 aligned with the air inlets 114. The flapper valves 116 are each adjacent one of the diaphragms 108 and provide one-way air flow.

Figure 14:
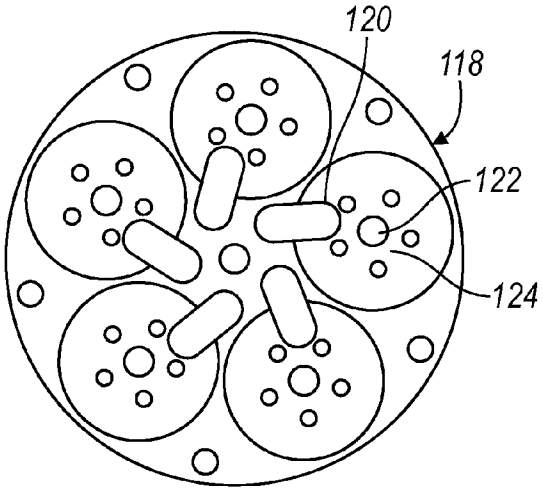
FIG. 14 is an enlarged axial perspective view of a second end cap of the air compressor assembly of FIG. 7.

A second end cap 118 is mounted to the retainer plate 98 for enclosing the compressor housing 76, and is illustrated in FIG. 14. The second end cap 118 has a series of channels 120 aligned with one of the flapper valves 116 and the adjacent diaphragm 108 for permitting air to pass through the flapper valve 116, through the channel 120 and into the adjacent diaphragm 108. Thus, as each diaphragm 108 is expanded, air is pulled through the inlet 114, the flapper valve 116, and the channel 120. As the diaphragm 108 is compressed, the flapper valve 116 seals the inlet 114. A series of outlets 122 are provided on the second end cap 118 and are aligned with the diaphragms. The outlets 122 are exhausted into the outlet duct 70. A flapper valve 124 is provided on each outlet 122 to permit exhaust of the compressed air only.

Thus, compressed air is provided to the air bladders 56, 58, 60, 62 conveniently, and efficiently that is controlled by user-selection, and readily deflated.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A body massage apparatus comprising:

a housing;

a massage unit provided in the housing;

a pair of laterally spaced apart air bladders provided on the housing with the massage unit oriented therebetween; and an air compressor assembly in fluid communication with the pair of air bladders for inflating the pair of air bladders, wherein the air compressor assembly comprises:

a compressor housing, an air inlet duct mounted to the compressor housing, a motor mounted to the compressor housing, and a diaphragm valve operably driven by the motor for compressing air;

wherein the pair of laterally spaced apart air bladders comprises two pairs of laterally spaced apart air bladders, each pair provided on the housing;

wherein each pair of air bladders comprises a first lumbar air bladder mounted to the housing, and a second lumbar air bladder mounted to the housing in between the first lumbar air bladder and the housing; and wherein the first lumbar air bladder is at least partially overlapped with the second lumbar air bladder, and the first lumbar air bladder is not aligned with the second lumbar air bladder to provide varied compression.

2. The massage apparatus of claim 1 wherein the massage unit comprises:

a carriage mounted in the housing for translation relative to the housing; and at least one massage formation provided on the carriage.

3. The body massage apparatus of claim 1 wherein the housing is sized to be seated upon a conventional chair;

wherein the housing has a pelvic region, a lumbar region, and a thoracic region; and wherein the pair of air bladders are mounted to the lumbar region of the housing.

4. The body massage apparatus of claim 1 wherein each pair of air bladders is fastened to the housing by a series of fasteners.

5. The body massage apparatus of claim 1 further comprising a valve assembly in fluid communication with the pair of air bladders for deflating the pair of air bladders.

6. The body massage apparatus of claim 5 further comprising an actuator operably connected to the valve assembly for actuating the valve assembly.

7. The body massage apparatus of claim 6 wherein the actuator comprises a solenoid.

8. The body massage apparatus of claim 1 wherein the compressor housing comprises a first end cap;

wherein the air inlet duct is mounted to the first end cap; and wherein the motor is mounted to the first end cap with a rotary output shaft extending through the first end cap and into the compressor housing.

9. The body massage apparatus of claim 8 wherein the air compressor assembly further comprises an eccentric drive mounted to the rotary output shaft; and wherein the compressor housing further comprises a drive plate mounted for rotation to the eccentric drive for oscillation within the compressor housing.

10. The body massage apparatus of claim 9 wherein the compressor housing further comprises an intermediate retainer plate mounted to the first end cap, the retainer plate having a series of apertures formed therethrough; and wherein the diaphragm valve further comprises a substrate retained against the retainer plate spaced apart from the drive plate, a series of diaphragms each disposed within one of the series of apertures in the retainer plate, and a series of elastomeric fasteners each mounted to one of the series of diaphragms and each fastened to the drive plate such that oscillation of the drive plate consequently oscillates each of the series of diaphragms.

11. The body massage apparatus of claim 10 wherein the compressor housing further comprises a second end cap having a series of outlet apertures, each aligned with one of the series of diaphragms.

12. The body massage apparatus of claim 11 wherein the compressor further comprises a series of outlet flapper valves each provided on one of the series of outlet apertures.

13. The body massage apparatus of claim 10 wherein the diaphragm valve further comprises a series of flapper valves each oriented adjacent one of the series of diaphragms for intake of air into each of the series of diaphragms.

14. The body massage apparatus of claim 11 further comprising an outlet duct mounted to the second end cap in fluid communication with each of the series of outlet apertures, and in fluid communication with each of the pair of air bladders.

* * * * *